US009515405B2

(12) United States Patent
Zhao et al.

(10) Patent No.: US 9,515,405 B2
(45) Date of Patent: Dec. 6, 2016

(54) ELECTRICAL CONNECTOR ASSEMBLY WITH METALLIC PLATE

(71) Applicant: Shenzhen Everwin Precision Technology Co., Ltd., Shenzhen, Guangdong Province (CN)

(72) Inventors: Huaguang Zhao, Shenzhen (CN); Yayong Li, Shenzhen (CN)

(73) Assignee: SHENZHEN EVERWIN PRECISION TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 14/792,514

(22) Filed: Jul. 6, 2015

(65) Prior Publication Data

US 2016/0006195 A1 Jan. 7, 2016

(30) Foreign Application Priority Data

Jul. 5, 2014 (CN) ..... 2014 1 0322706
Aug. 12, 2014 (CN) ..... 2014 1 0395693

(51) Int. Cl.
*H01R 13/648* (2006.01)
*H01R 13/405* (2006.01)
*H01R 13/504* (2006.01)
*H01R 13/6585* (2011.01)

(52) U.S. Cl.
CPC ..... *H01R 13/405* (2013.01); *H01R 13/504* (2013.01); *H01R 13/6585* (2013.01)

(58) Field of Classification Search
CPC ..... H01R 13/6587; H01R 13/6593; H01R 23/6873; H01R 23/7073
USPC ..... 439/607.11, 607.4, 607.35, 660
See application file for complete search history.

(56) References Cited

U.S. PATENT DOCUMENTS 7,670,156 B2 * 3/2010 Chen ..... H01R 13/6485 439/108
8,851,927 B2 * 10/2014 Hsu ..... H01R 13/6594 439/607.11
9,209,573 B1 * 12/2015 Chen ..... H01R 13/6581
9,281,643 B1 * 3/2016 Tseng ..... H01R 24/78
2015/0244111 A1 * 8/2015 Ju ..... H01R 13/6585 439/607.05
2016/0020568 A1 * 1/2016 Ju ..... H01R 24/78 439/607.01
2016/0036169 A1 * 2/2016 Hu ..... H01R 13/6585 439/607.05
2016/0049756 A1 * 2/2016 Yen ..... H01R 24/60 439/676

* cited by examiner

*Primary Examiner* — Phuong Dinh
(74) *Attorney, Agent, or Firm* — Miles & Stockbridge P.C.

(57) ABSTRACT

The present invention relates to an electrical connector assembly comprising: an insulative housing; a metallic plate formed in the insulative housing; a first terminal module formed on a top surface of the insulative housing; a second terminal module formed on a bottom surface of the insulative housing; and a metallic shell assembled to and formed around the insulative housing.

12 Claims, 17 Drawing Sheets

ELECTRICAL CONNECTOR ASSEMBLY WITH METALLIC PLATE

TECHNICAL FIELD

The present invention relates to an electrical connector assembly and method of manufacturing the same, and more particularly to an electrical connector assembly having a metallic plate formed therein.

BACKGROUND ART

The universal series bus is a popular interface for computer peripherals to connect to each other. The standard was updated from USB 1.0/1.1 to USB 2.0 and then updated from USB 2.0 to USB 3.0. The USB 3.0 is a signal transmission standard developed from the USB 2.0. The maximum speed of the USB 3.0 is 5 gigabytes/s, but that of the USB 2.0 is only 480 megabytes/s. Currently, an electrical connector based on the USB 3.0 is compalible with an electrical connector based on the USB 2.0. That is, the electric connector based the USB 3.0 is equipped with the same structure of the electric connector based on the USB 2.0 and additionally is configured with a plurality of pins providing functions for the USB 3.0.

And, the USB 3.0 Promoter Group has finished the specification for its new, reversible USB connector design which is called USB 3.1 Type-C connector last December. The Type-C connector is about the same size as the Micro USB connector, but it's symmetrical, which allows it to be plugged in two orientations with no ill effects. The maximum speed of the Type C is 10 gigabytes/s.

Accordingly, the speed and frequency of USB connector may be enhanced through the updating of the transmission interface, but how to overcome a crosstalk effective occurred due to the high speed and high frequency of the electrical connector based the Type-C connector, is one of major issues in the industry.

So, an electrical connector assembly with good effectiveness of cross talk prevention and EMI suppression is needed.

SUMMARY OF INVENTION

Accordingly, an object of the present invention is to provide an electrical connector assembly having good effectiveness of cross talk prevention and EMI suppression.

In order to achieve the object set forth, an electrical connector assembly comprises an insulative housing; a metallic plate formed in the insulative housing; a first terminal module formed on a top surface of the insulative housing; a second terminal module formed on a bottom surface of the insulative housing; and a metallic shell assembled to and formed around the insulative housing.

In order to achieve the object set forth, a method of manufacturing an electrical connector assembly, comprises the steps of: providing a first terminal module and a second terminal module stacked with each other; providing a metallic plate sandwiched between the first and second terminal module; molding an insulative housing to the metallic plate and the first and second terminal module; and providing a metallic shell surrounding the insulative housing.

In order to achieve the object set forth, a method of manufacturing an electrical connector assembly, comprises the steps of: providing an insulative housing having a metallic plate formed therein; assembling a first terminal module to a top surface of the insulative housing; assembling a second terminal module to a bottom surface of the insulative housing; providing a metallic clamp binding the insulative housing, the first and and second terminal modules; and providing a metallic shell surrounding the insulative housing.

Other objects, advantages and novel features of the invention will become more apparent from the following detailed description when taken in conjunction with the accompanying drawings.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF PREFERRED EMBODIMENTS

Figure 1:
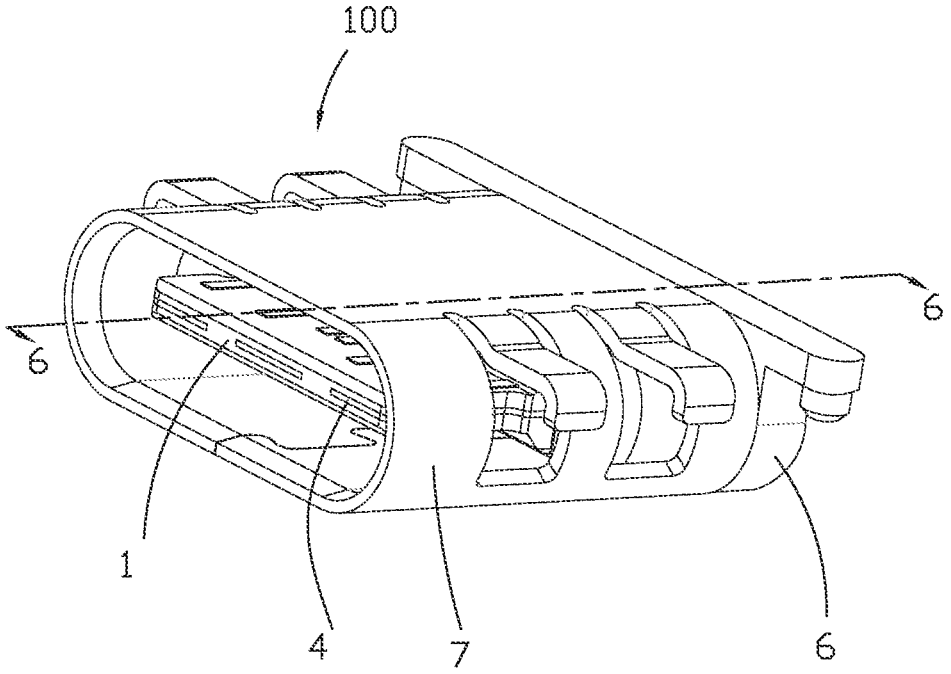
FIG. 1 is an assembled perspective view of an electrical connector assembly according to a first embodiment of the present invention.
Figure 2:
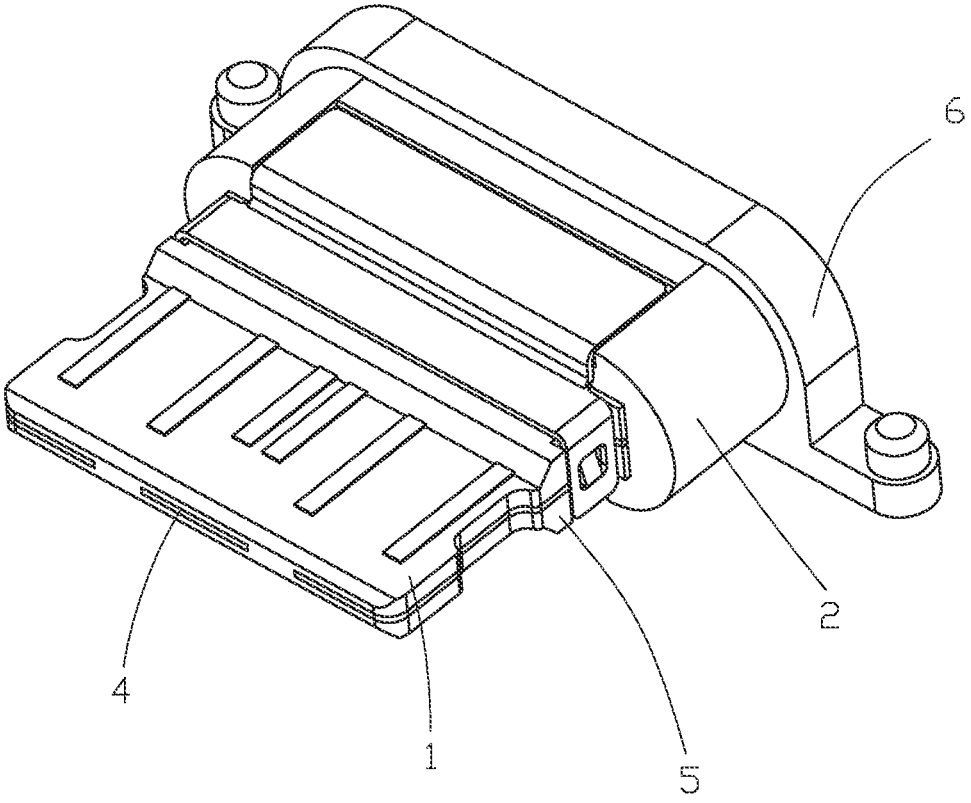
FIG. 2 is a perspective view of the electrical connector assembly without metallic shell.

Reference will now be made to the drawing figures to describe the embodiments of the present invention in detail.

In the following description, the same drawing reference numerals are used for the same elements in different drawings.

Referring to FIGS. 1 to 6, an electrical connector assembly 100 according to the first embodiment of the present invention comprises an insulative housing 1, a first terminal module 2 and a second terminal module 3 assembled to top and bottom sides of the insulative housing 1, a metallic plate 4 formed in the insulative housing 1 and sandwiched between the first and second terminal modules 2, 3, a metallic clamp 5 surrounding the insulative housing 1, a rear insulator 6 molding to a rear end of the insulative housing 1, and a metallic shell 7 surrounding the insulative housing 1. The electrical connector assembly 100 is a symmetrical USB receptacle connector which allows it to be plugged in two orientations.

Referring to FIGS. 2 to 6, the insulative housing 1 comprises a base portion 11, a tongue portion 12 and a middle portion 13 disposed between the base portion 11 and the tongue portion 12. The tongue portion 12 defines two first recesses 121 formed at two sides thereof. The middle portion 13 defines a second recess 131 extending inwardly from outer surface thereof. The base portion 11 defines two third recesses 111 respectively formed on top surface and bottom surface thereof.

Figure 3:
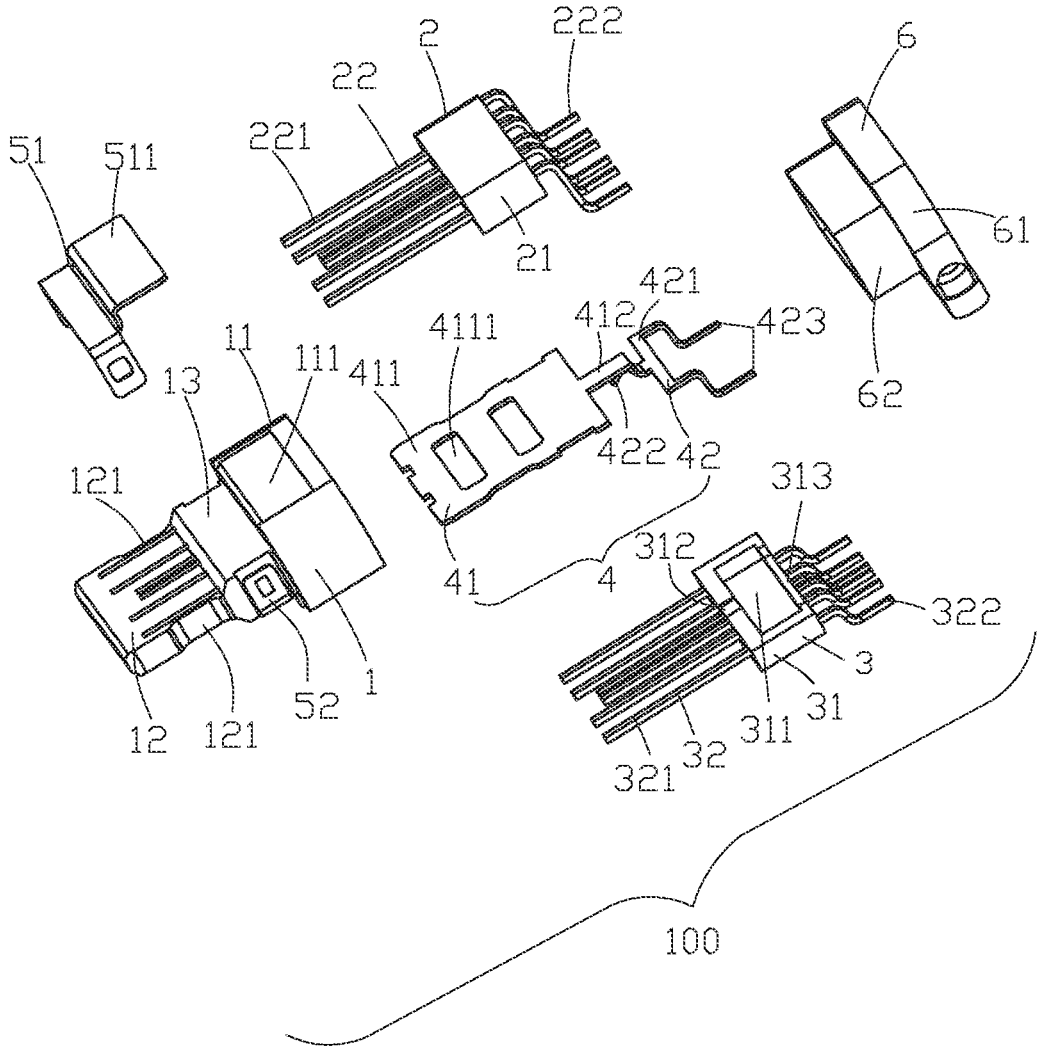
FIG. 3 is an exploded view of the electrical connector assembly according to the first embodiment of present invention.
Figure 4:
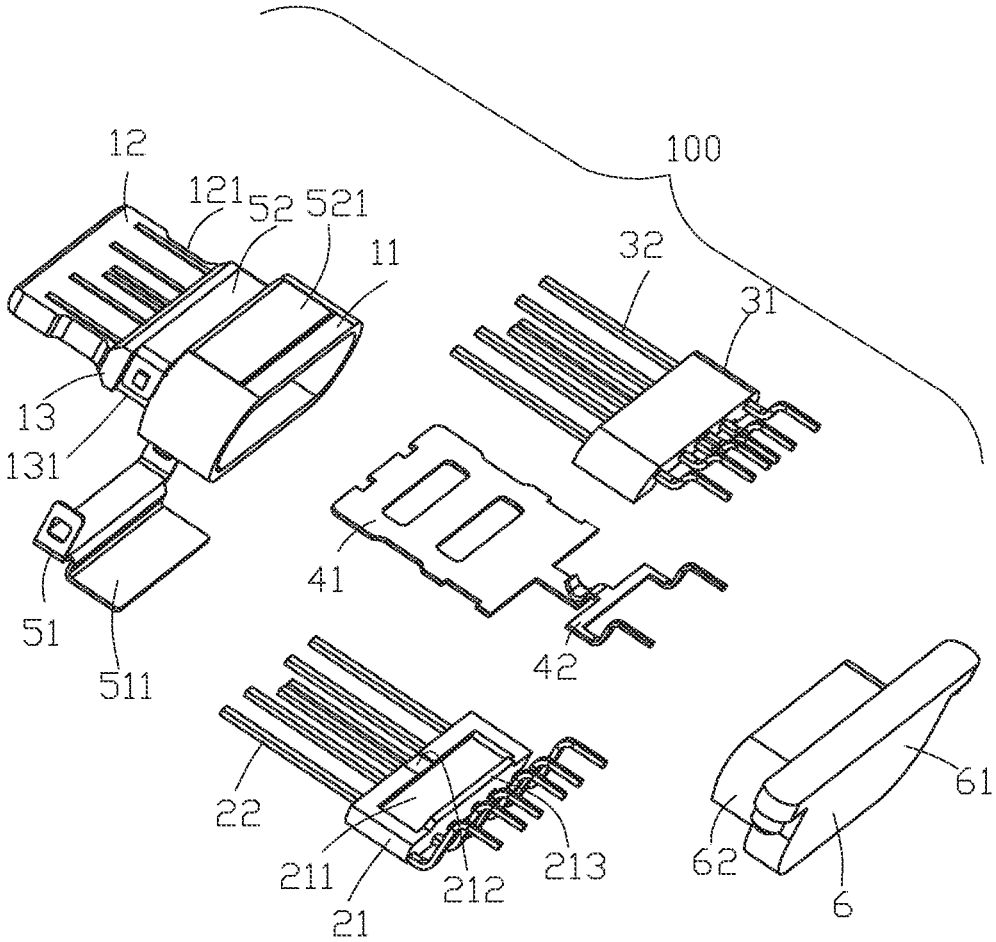
FIG. 4 is a view similar to FIG. 3, while taken from a different aspect.
Figure 5:
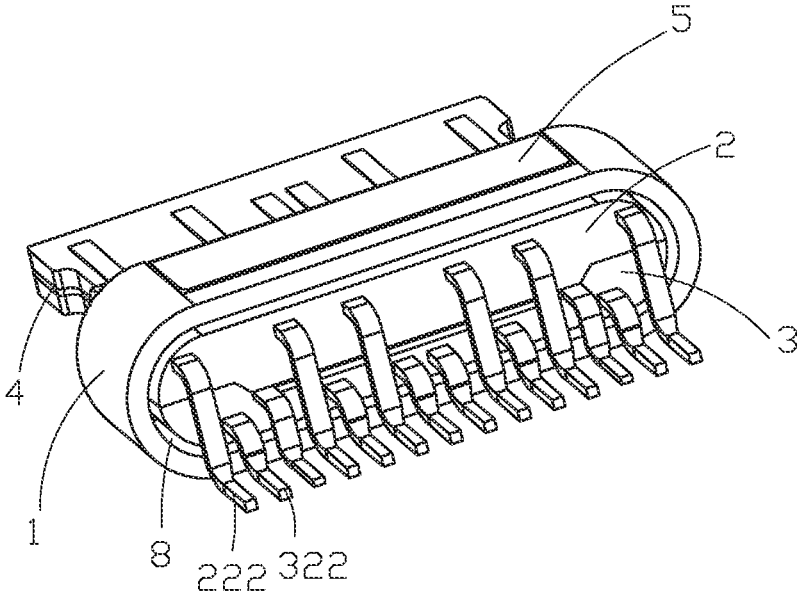
FIG. 5 is a perspective view of the electrical connector assembly without metallic shell and rear insulator.

Referring to FIGS. 3 to 4, the first terminal module 2 comprises a first insulator 21 and a plurality of first terminals 22 integrated with the first insulator 21 by an insert molding process. The second terminal module 3 comprises a second insulator 31 and a plurality of second terminals 32 integrated with the second insulator 31 by an insert molding process. Each of first terminal 22 defines a front mating portion 221 and a rear soldering portion 222. Each of second terminal 32 defines a front mating portion 321 and a rear soldering portion 322. A plurality of soldering portions 222, 322 are located on a same plane when the first terminal module 2 and the second terminal module 3 assembled together.

The first insulator 21 defines a first groove 211 and a first slot 212 formed on a bottom surface thereof and communicated with each other. The first insulator 21 further defines a rib 213 extending downwardly from a bottom surface thereof. The second insulator 31 also defines a second groove 311, a second slot 312 and a third slot 313 formed on a top surface thereof and communicated with each other. The third slot 313 is cooperated with the rib 213. A channel is formed by the first and second slots 212, 312 when the when the first and second terminal modules 2, 3 are assembled with each other in an up-to-down direction. And, a receiving room 23 is also formed by the first and second grooves 211, 311 when the first and second terminal modules 2, 3 are assembled with each other in an up-to-down direction. The first and second terminal modules 2, 3 are respectively integrated with the insulative housing 1 through an insert molding process. The plurality of first and second terminals 22, 32 are respectively located on top and bottom surfaces of the insulative housing 1 for mating with a complementary connector (not shown in the FIGS.)

Referring to FIGS. 3 to 6, the metallic plate 4 is integrated with the insulative housing 1 to reinforce the tongue portion 12 of the insulative housing 1. The metallic plate 4 is also sandwiched between the first and second terminal modules 2, 3 for reducing cross talk and electromagnetic interference when the first and second terminals 22, 32 are in high-speed signal transmission. The metallic plate 4 comprises a first metallic piece 41 and a second metallic piece 42 connected with each other. The first metallic piece 41 defines a body portion 411 having a plurality of holes 4111 and a rear portion 412 extending rearwardly from the body portion 411. Two sides of the first metallic piece 41 are extended to two side surfaces of the tongue portion 12 of the insulative housing 1. Thus, the tongue portion 12 will not be scratched by latch of a complementary connector (not shown in FIGS.). The second metallic piece 42 defines a body portion 421, an elastic contact portion 422 extending forwardly from a front edge of the body portion 421 and two rear portions 423 extending rearwardly and downwardly from a rear edge of the body portion 421. The rear portion 412 and elastic contact portion 422 can be respectively extended into the receiving room 23 from front and rear ends of the first and second insulator 21, 22. The metallic plate 4 can be electrically contacted with an outside grounding loop to achieve an good effectiveness of cross talk prevention and EMI suppression for the electrical connector assembly 100.

Referring to FIGS. 2 to 6, the metallic clamp 5 is structured in circular shape and received into the second recess 131. The metallic clamp 5 comprises a first piece 51 and second piece 52 engaged with each other. The first piece 51 of metallic clamp 51 comprises extending portion 511 received into the third recess 111 of the base portion 11 of the insulative housing 1.

Referring to FIGS. 1 to 4 and 6, the rear insulator 6 is molded to a rear end of the insulative housing 1 and the first and second terminal modules 2, 3. The rear insulator 6 comprises a base portion 61 and an extending portion 62 received into a receiving space 8 between the insulative housing 1 and the first and second insulator 21, 31. The extending portion 62 is structured in a circular shape. The base portion 61 is attached to a rear surface of the insulative housing 1.

Figure 6:
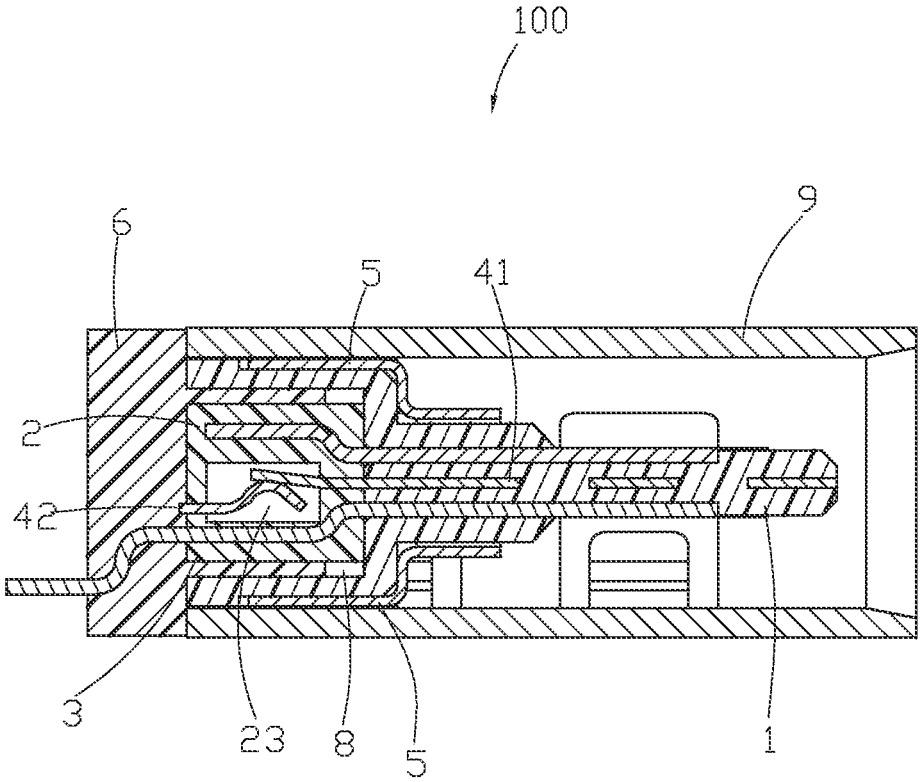
FIG. 6 is a cross-sectional view of the electrical connector assembly according to the first embodiment of the present invention taken along line 1-1 of FIG. 1.
Figure 7:
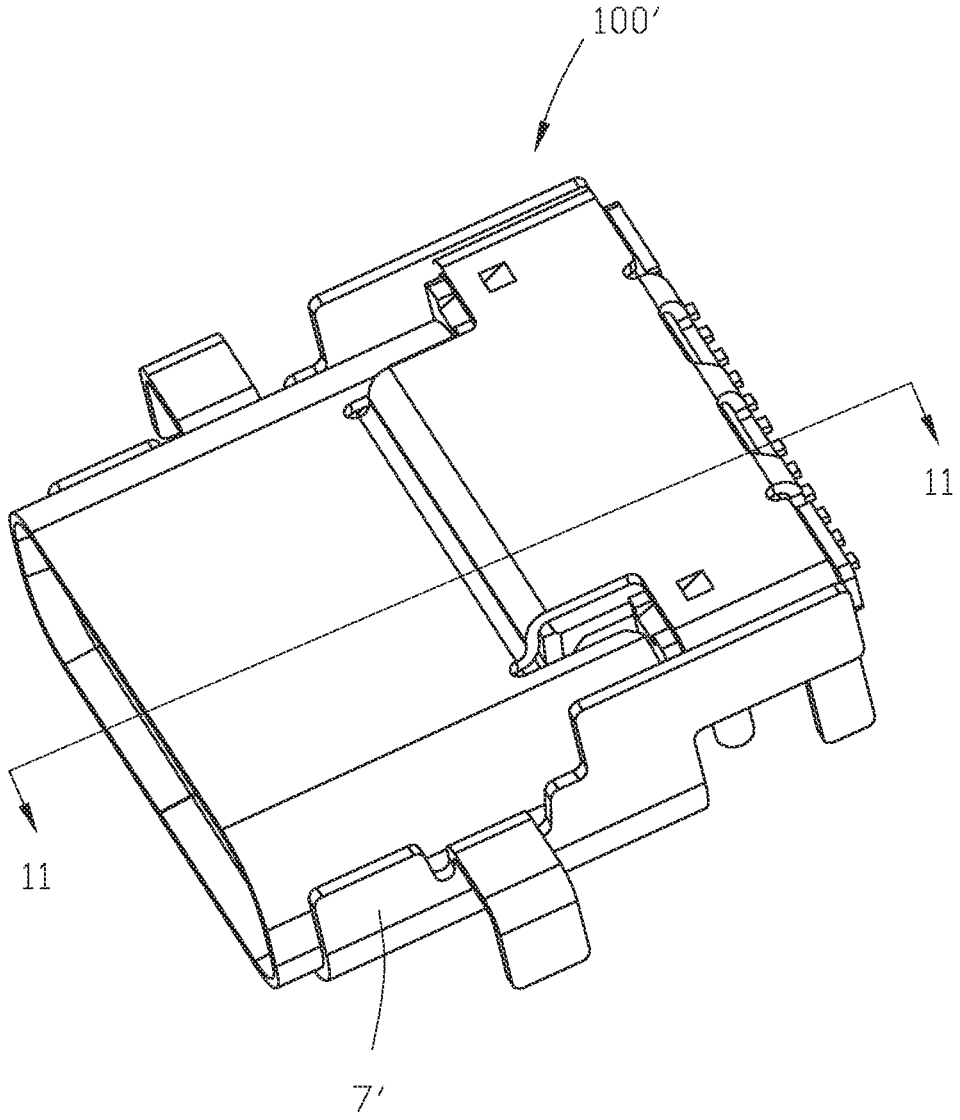
FIG. 7 is an assembled perspective view of an electrical connector assembly according to a second embodiment of the present invention.
Figure 8:
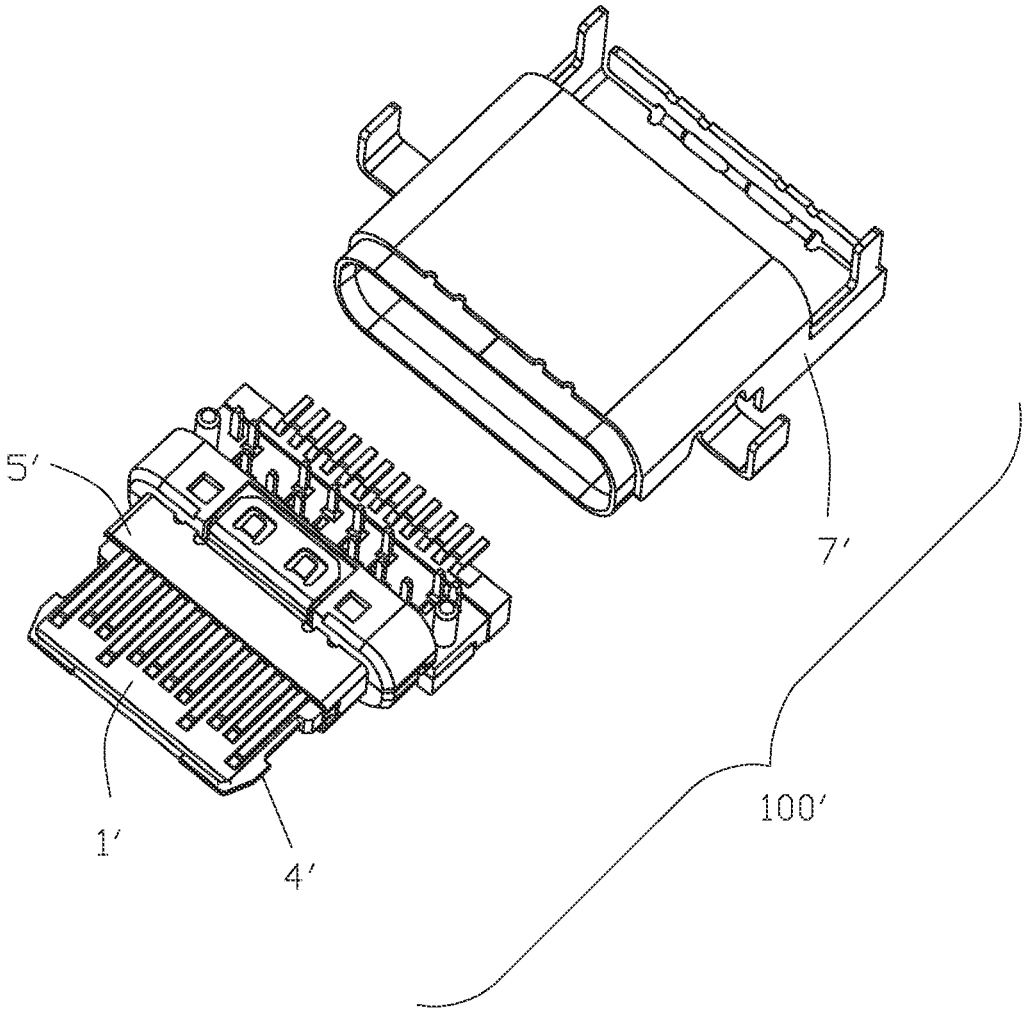
FIG. 8 is a partial exploded view of the electrical connector assembly according to the second embodiment of present invention.

Referring to FIGS. 1 and 6, the metallic shell 7 surrounds the insulative housing 1. The metallic shell 7 is attached to the base portion 61 of the insulative housing 1 and interfered with the extending portion 51 of the metallic clamp 5 which is received into the third recess 111 of the base portion 11 of the insulative housing 1. Thus, the metallic shell 7 is further engaged with the insulative housing 1 by the metallic clamp 5.

Referring to FIGS. 1 to 6, the manufacturing process of the electrical connector assembly 100 made in according to the first embodiment of the present invention starts from assembling the first terminal module 2, the second terminal module 3 and the metallic plate 4 together. The metallic plate 4 is sandwiched between the first and second terminal modules 2, 3. The first metallic piece 41 and a second metallic piece 42 are connected with each other in a receiving room 23 formed by the first and second insulators 21, 31.

Then, mold the insulative housing 1 to the first and second terminal modules 2, 3 and the metallic plate 4.

Then, assemble the metallic clamp 5 to the second recess 131 of the middle portion 13 of the insulative housing 1.

Then, mold the rear insulator 6 to the rear end of the insulative housing 1 and the first and second terminal modules 2, 3. The extending portion 62 of the rear insulator 6 is received into the receiving space 8. The base portion 61 is attached to the rear surface of the insulative housing 1.

Finally, assemble the metallic shell 7 to the insulative housing 1.

After the above assembling steps, the entire process of manufacturing of the electrical connector assembly 100 made in according to the first embodiment of the present invention is finished. Actually, the electrical connector assembly 100 has a good effectiveness of cross talk and EMI suppression due to the metallic plated 4 sandwiched between the first and second terminal modules 2, 3. The electrical connector assembly 100 is also easily manufactured. And, a method of manufacturing the electrical connector assembly 100 is efficiency and accuracy.

Referring to FIGS. 7 to 17, an electrical connector assembly 100' according to the second embodiment of the present invention comprises an insulative housing 1', a first terminal module 2' and a second terminal module 3' assembled to top and bottom sides of the insulative housing 1', a metallic plate 4' formed in the insulative housing 1' and sandwiched between the first and second terminal modules 2', 3', a metallic clamp 5' binding the insulative housing 1', the first and second terminal modules 2', 3', and a metallic shell 7' surrounding the insulative housing 1' and a first and second terminal module 2', 3'. The electrical connector assembly 100' is a symmetrical USB Type-C receptacle connector which allows it to be plugged in two orientations.

Figure 9:
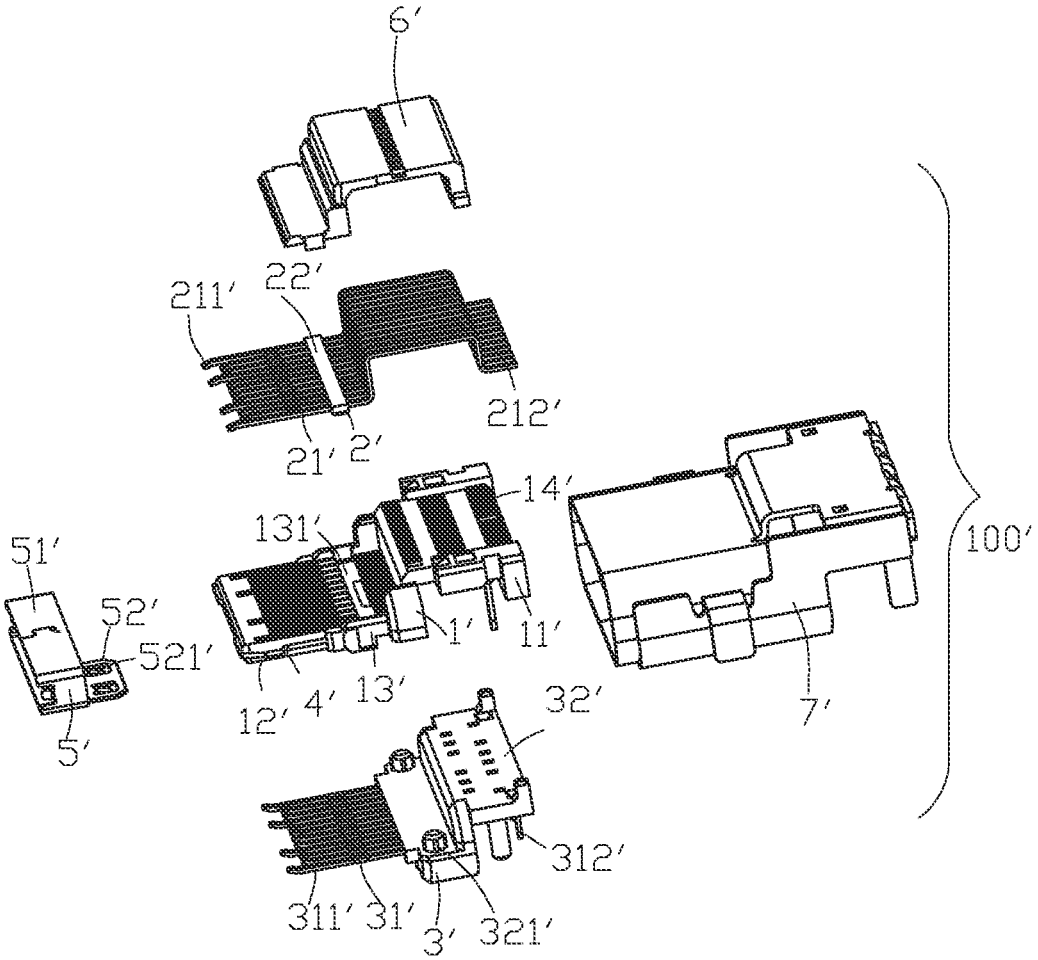
FIG. 9 is an exploded view of the electrical connector assembly according to the second embodiment of present invention.
Figure 10:
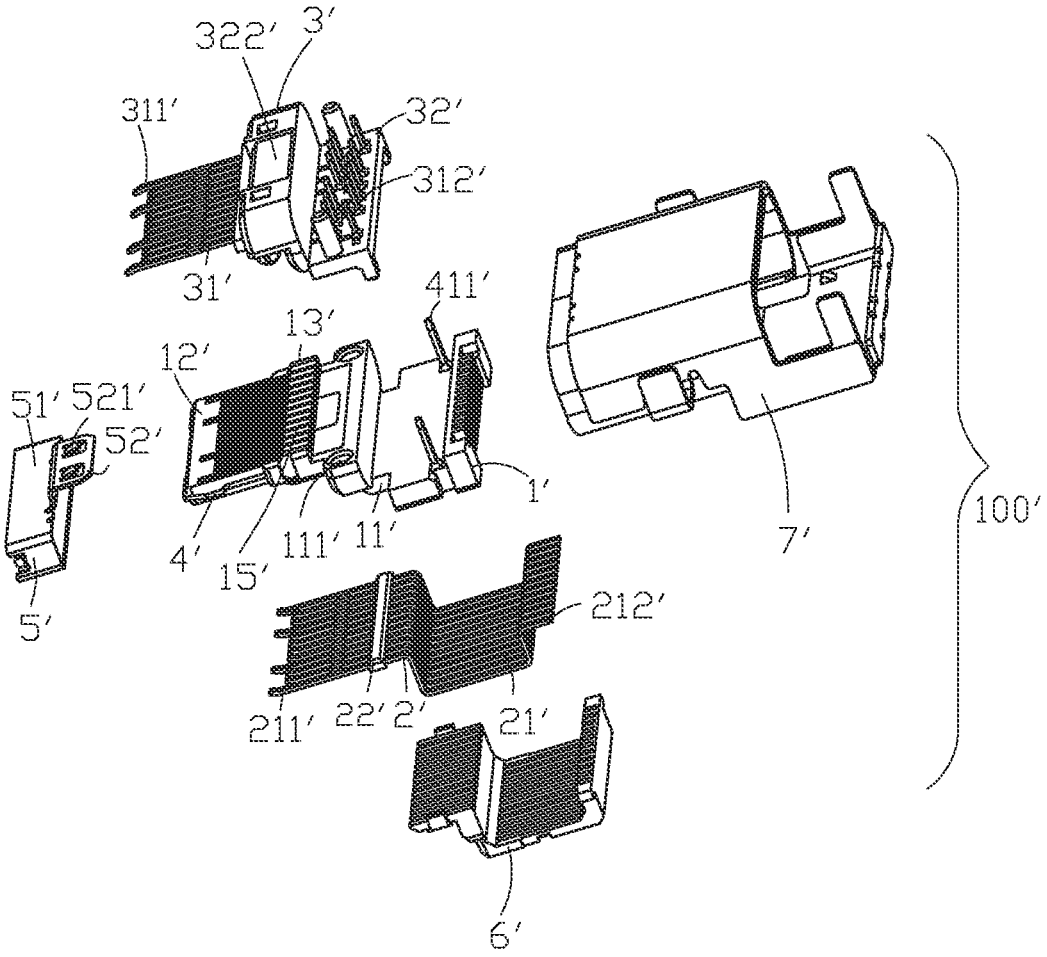
FIG. 10 is a view similar to FIG. 9, while taken from a different aspect.
Figure 13:
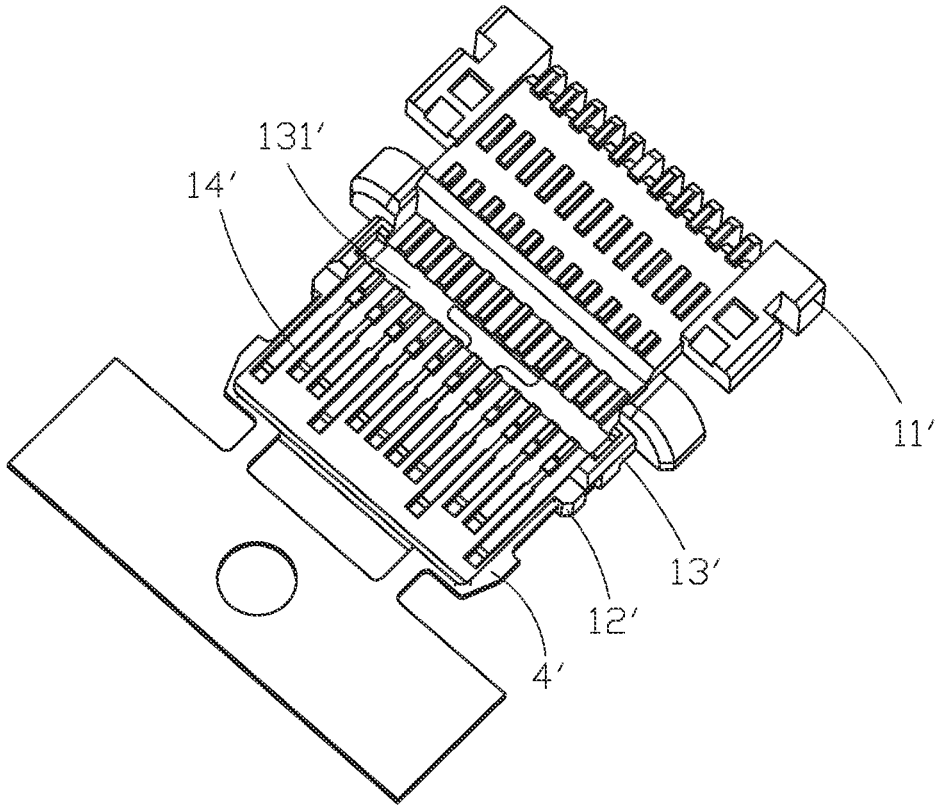
FIG. 13 is a perspective view of metallic plate integrated with an insulative housing of the electrical connector assembly according to the second embodiment of present invention.
Figure 14:
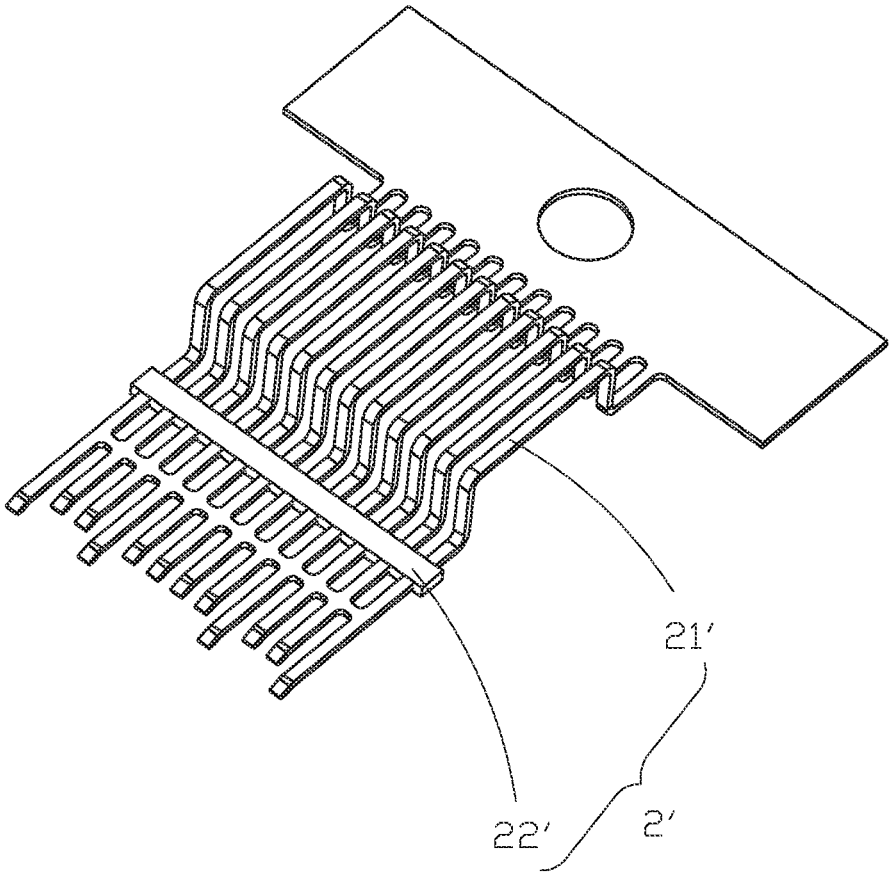
FIG. 14 is a perspective view of a first terminal module of the electrical connector assembly according to the second embodiment of present invention.
Figure 15:
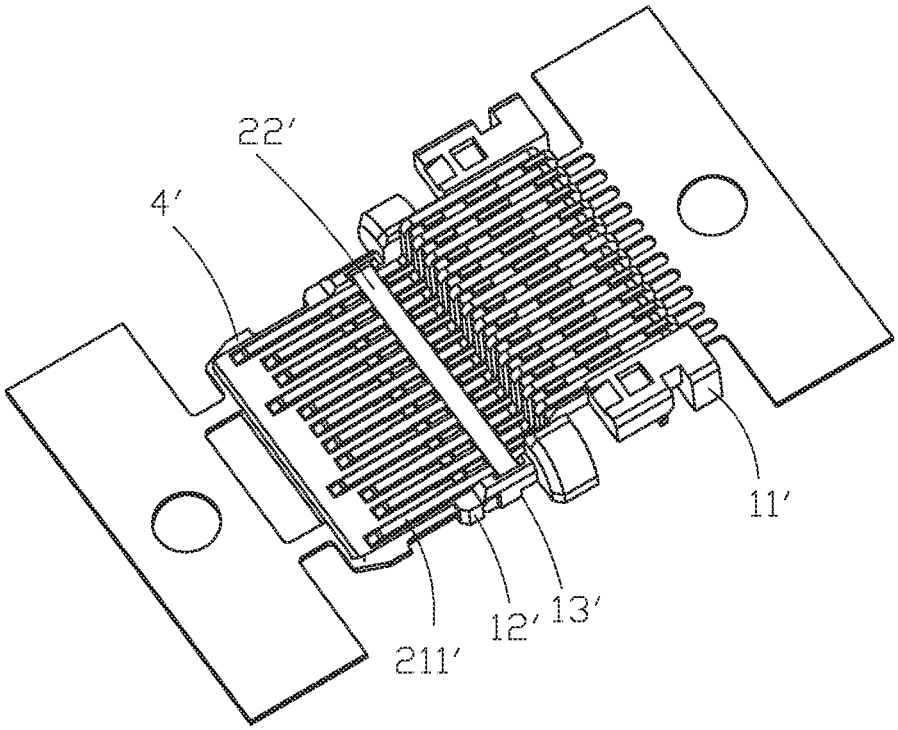
FIG. 15 is a perspective view of a sub-assembly of the first terminal module and the insulative housing according to the second embodiment of present invention.
Figure 16:
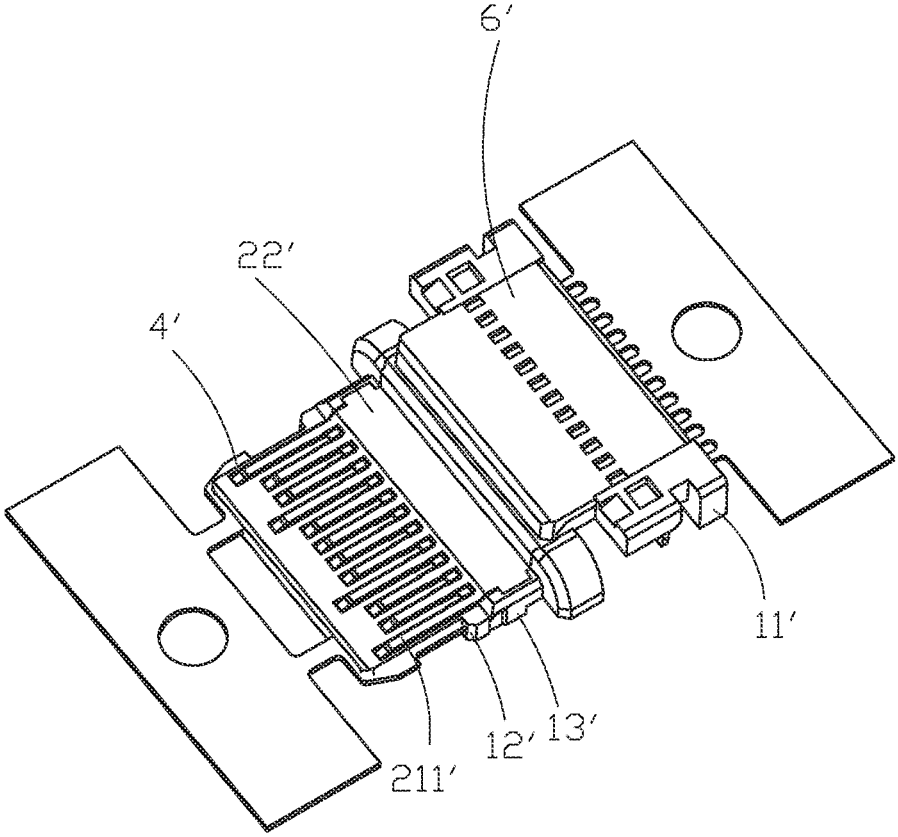
FIG. 16 is a perspective view of a sub-assembly of the first terminal module, the insulative housing and an upper insulator according to the second embodiment of present invention.
Figure 17:
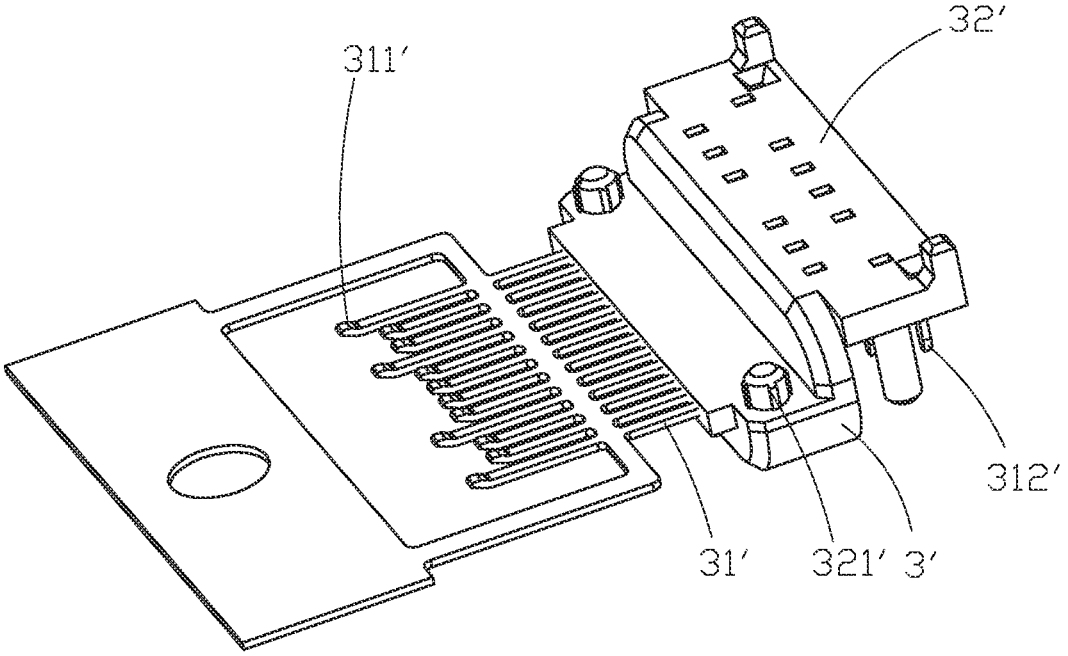
FIG. 17 is a perspective view of a second terminal module according to the second embodiment of present invention.

Referring to FIGS. 9, 10 and 13, the insulative housing 1' defines a base portion 11', a tongue portion 12' and a middle portion 13' located between the base portion 11' and a tongue portion 12'. The insulative housing 1' is structured in a step shape. The tongue portion 12' and the middle portion 13' are located in a same plane. The base portion 11' is structured in a n shape. The insulative housing 1' defines a plurality of receiving slots 14', 15' respectively formed on top and bottom surfaces thereof. The middle portion 13' defines a recess 131' formed on the top surface thereof. The base portion 11' of the insulative housing 1' further defines two positioning holes 111' on the bottom surface of the base portion 11'.

Referring to FIGS. 9 to 10, the first and second terminal module 2' 3' are respectively assembled to the top and bottom surface of the insulative housing 1'. The first terminal module 2' comprises a plurality of first terminals 21' received into the receiving slots 14' and a first insulator 22' integrated with each other. The second terminal module 3' comprises a plurality of second terminals 31' received into the receiving slots 15' and a second insulator 32' integrated with each other. Each of first terminal 21' defines a flat mating portion 211' and a flat soldering portion 212'. The first insulator 22' is structured in a rectangular shape and received into the recess 131'. The first insulator 22' is attached to the metallic plate 4'. Each of second terminal 31' defines a flat mating portion 311' and a vertical soldering portion 312'. The second insulator 32' assembled to a bottom surface of the base portion 11'. The second insulator 32' defines two positioning posts 321' formed on a top surface thereof for cooperated with the corresponding positioning holes 111' and a groove 322' formed on a bottom surface thereof.

Referring to FIGS. 8 to 13, the metallic plate 4' is integrated with the insulative housing 1' by insert molding process to reinforce the insulative housing 1'. The metallic plate 4' defines an L-shape rear portion 41' and a flat front portion 42'. The rear portion 41' defines two vertical soldering portions 411'. The front portion 42' defines two locking portions 421' formed at two sides thereof for cooperating with a complementary connector (not shown in FIGS.). The two sides of the metallic plate 4' extend out of two side surfaces of the insulative housing 1'. Thus, the tongue portion 12' will not be scratched by two latches of a complementary connector (not shown in FIGS.). The front portion 42' further defines a hole 422' for easily and firmly integrating with the insulative housing 1'. The metallic plate 4' can be electrically contacted with an outside grounding loop to achieve an good effectiveness of cross talk prevention and EMI suppression for the electrical connector assembly 100' by the two vertical soldering portions 411'.

Referring to FIGS. 9 to 10, a metallic clamp 5' is structured in a circular shape. The metallic clamp 5' defines a circular base portion 51' and an extending portion 52' extending rearwardly from the base portion 51'. The extending portion 52' can be received into the groove 322'. The metallic clamp 5' is used for binding the insulative housing 1', the first and second terminal modules 2', 3' together. The extending portion 52' defines two elastic tabs 521'.

Figure 11:
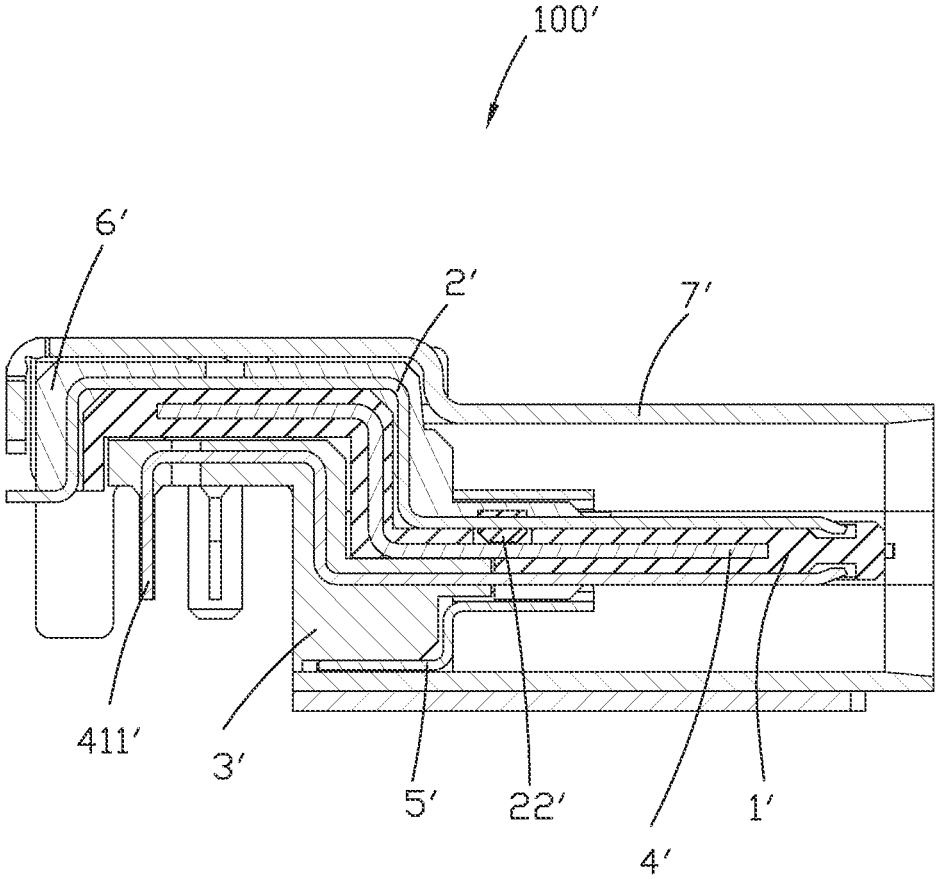
FIG. 11 is a cross-sectional view of the electrical connector assembly according to the second embodiment of the present invention t taken along line 7-7 of FIG. 7.
Figure 12:
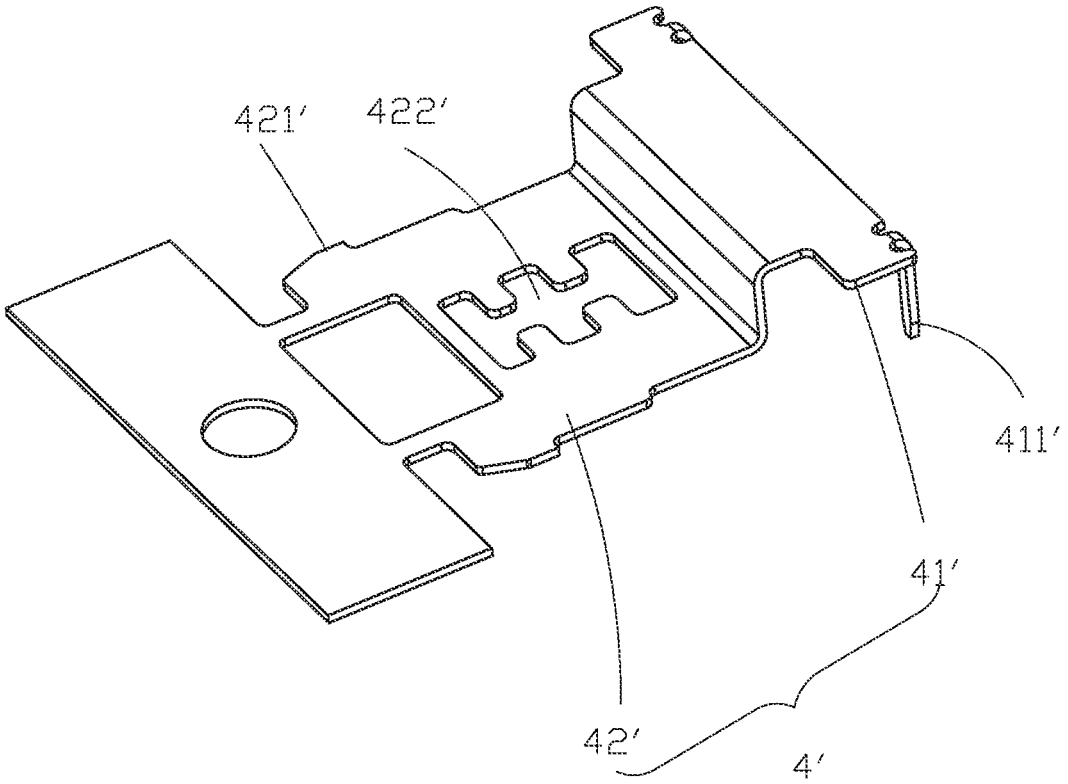
FIG. 12 is a perspective view of metallic plate of the electrical connector assembly according to the second embodiment of present invention.

Referring to FIGS. 9 to 11, the metallic shell 7' is structured in a frame shape. The metallic shell 7' is assembled to and surrounds the insulative housing 1', the first and second terminal modules 2', 3'.

Referring to FIGS. 9 to 11, the electrical connector assembly 100' according to the second embodiment of the present invention further comprises a third insulator 6' molding to the insulative housing 1' and the first terminal module 2' and received into the metallic shell 7'.

Referring to FIGS. 8 to 17, the manufacturing process of the electrical connector assembly 100' made in according to the first embodiment of the present invention starts from molding the metallic plate 4' and the insulative housing 1'. The two sides of the metallic plate 4' extend out of two side surfaces of the insulative housing 1'. Two soldering portions 411 also extend out of the insulative housing 1'.

Then, assemble the first and second terminal modules 2', 3' respectively to the top and bottom surface of the insulative housing 1'. The plurality of first and second terminals 22', 32' are respectively received into the receiving slots 14', 15'. The first insulator 21' is received into the recess 131'. The second insulator 31' is assembled to the bottom surface of the base portion 11'. And, two positioning posts 321' are received into the positioning holes 111'.

Then, mold the third insulator 6' to the insulative housing 1' and the first terminal module 2'. Thus, the first terminal module 2' can be firmly positioned to the insulative housing 1'.

Then, assemble the metallic clamp 5' to the middle portion of the insulative housing 1', the first and second terminal modules 2', 3' and the third insulator 6'. The extending portion 52' of the metallic clamp 5' is received into the groove 322'.

Finally, assemble the metallic shell 7' to the periphery of the insulative housing 1', the first and second terminal modules 2', 3' and third insulator 6'. And, inner surface of the metallic shell 7' contacts with the two elastic tabs 521' of the metallic clamp 5'.

After the above assembling steps, the entire process of manufacturing of the electrical connector assembly 100' made in according to the second embodiment of the present invention is finished. Actually, the electrical connector assembly 100' has a good effectiveness of cross talk prevention and EMI suppression due to the metallic plate 4' sandwiched between the first and second terminal modules 2', 3'. The electrical connector assembly 100' is also easily manufactured. And, a method of manufacturing the electrical connector assembly 100' is efficiency and accuracy.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing;

a metallic plate formed in the insulative housing;

a first terminal module formed in the insulative housing;

a second terminal module formed in the insulative housing; and a metallic shell assembled to and formed around the insulative housing;

wherein the first terminal module includes a first insulator and a plurality of first terminals integrated with the first insulator, the second terminal module includes a second insulator and a plurality of second terminals integrated with the second insulator, the metallic plate being between the first and second insulator;

wherein the first and second insulator are stacked with each other, a receiving room being formed between the first and second insulator;

wherein the metallic plate includes a first metallic piece and a second metallic piece connected with each other; and wherein a connecting area between the first metallic piece and second metallic piece is located in the receiving room.

2. The electrical connector assembly as recited in claim 1, wherein the first metallic piece defines a first body portion and a first rear portion extending into the receiving room, the second metallic piece defines an elastic contact portion extending into the receiving room and electrically connected with the first rear portion of the first metallic piece.

3. The electrical connector assembly as recited in claim 2, wherein the second metallic piece further defines a second body portion and two second rear portions extending rearwardly from the body portions and out of the insulative housing, the elastic contact portion extends forwardly from the second body portion.

4. The electrical connector assembly as recited in claim 1, wherein the electrically connector assembly further comprises a rear insulator molded to a rear end of the insulative housing.

5. The electrical connector assembly as recited in claim 4, wherein a receiving space is formed between the insulative housing and the first and second insulator, the rear insulator defines a portion received into the receiving space.

6. The electrical connector assembly as recited in claim 1, wherein the electrical connector assembly further comprises a metallic clamp assembled to the insulative housing and contact with the metallic shell.

7. The electrical connector assembly as recited in claim 1, wherein the plurality of first terminals define a plurality of front mating portions extending to a top surface of the insulative housing, the plurality of second terminals define a plurality of front mating portions formed on a bottom surface of the insulative housing.

8. The electrical connector assembly as recited in claim 1, wherein the electrical connector assembly is a USB Type C connector.

9. The electrical connector assembly as recited in claim 1, wherein the first insulator defines a first groove formed on a bottom surface thereof, the second insulator defines a second groove formed on a top surface thereof, the receiving room is formed by the first and second grooves.

10. The electrical connector assembly as recited in claim 7, wherein the plurality of first terminals define a plurality of first rear soldering portions, the plurality of second terminals define a plurality of second soldering portions, the first and second rear soldering portions are located on a same plane.

11. An electrical connector assembly comprising:

an insulative housing;

a metallic plate formed in the insulative housing;

a first terminal module assembled to a top surface of the insulative housing, and comprising a first insulator and a plurality of first terminals integrated with each other;

a second terminal module formed assembled to a bottom surface of the insulative housing, and including a second insulator and a plurality of second terminals integrated with each other;

a metallic clamp binding the insulative housing, the first and second terminal modules;

a third insulator molding to the top surface of the insulative housing and the first terminal module; and a metallic shell surrounding the insulative housing, the first and second terminal modules and the third insulator.

12. The electrical connector assembly as recited in claim 11, wherein the insulative housing defines a recess formed on the top surface thereof, the first insulator is received into the recess and attached to the metallic plate.

* * * * *